US009056462B2

(12) United States Patent
Wijnstekers et al.

(10) Patent No.: US 9,056,462 B2
(45) Date of Patent: Jun. 16, 2015

(54) INK JET PRINTING METHOD AND PRINTER

(71) Applicant: OCE-TECHNOLOGIES B.V., Venlo (NL)

(72) Inventors: Matheus Wijnstekers, Velden (NL); Henricus C. M. Van Genuchten, Eindhoven (NL); Björn H. A. J. M. Ketelaars, Tilburg (NL)

(73) Assignee: OCE-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 14/256,240

(22) Filed: Apr. 18, 2014

(65) Prior Publication Data

US 2014/0225948 A1 Aug. 14, 2014

Related U.S. Application Data

(63) Continuation of application No. PCT/EP2012/069919, filed on Oct. 9, 2012.

(30) Foreign Application Priority Data

Oct. 20, 2011 (EP) ..... 11185928

(51) Int. Cl.

| | |
|---|---|
| ***B41J 29/38*** | (2006.01) |
| ***B41J 29/393*** | (2006.01) |
| ***B41J 2/07*** | (2006.01) |
| ***B41J 2/21*** | (2006.01) |

(52) U.S. Cl.
CPC *B41J 2/07* (2013.01); *B41J 2/2135* (2013.01); *B41J 2/2139* (2013.01); *B41J 2/2142* (2013.01)

(58) Field of Classification Search
CPC ..... B41J 2/07; B41J 2/2142; B41J 2/2139; B41J 2/2135; B41J 2002/20; B41J 2/04505; B41J 2/04581; B41J 2/04526
USPC ..... 347/9, 12, 19
See application file for complete search history.

(56) References Cited

U.S. PATENT DOCUMENTS

| | | | | |
|---|---|---|---|---|
| 6,270,187 | B1 * | 8/2001 | Murcia et al. | 347/43 |
| 6,412,903 | B1 | 7/2002 | Lee et al. | |
| 6,669,321 | B2 | 12/2003 | Yoshida | |
| 2002/0030708 | A1 | 3/2002 | Yoshida | |
| 2002/0041299 | A1 | 4/2002 | Lee et al. | |

FOREIGN PATENT DOCUMENTS

| | | | |
|---|---|---|---|
| EP | 1 010 531 | A1 | 6/2000 |
| WO | WO 00/58101 | A1 | 10/2000 |
| WO | WO 2013/057007 | A1 | 4/2013 |

* cited by examiner

*Primary Examiner* — Jannelle M Lebron
(74) *Attorney, Agent, or Firm* — Birch, Stewart, Kolasch & Birch, LLP

(57) ABSTRACT

A method includes deriving from print data a first intended position of a first dot to be printed, determining a first printing element from a plurality of printing elements suitable for printing the first dot at the first intended position, printing the first dot with the first printing element at a first location on the substrate, deriving from the print data a second intended position of a second dot to be printed, retrieving a tolerated deviation of a distance between the first intended position and the second intended position, determining a second printing element from the plurality of printing elements suitable for printing the second dot based on the tolerated deviation, and printing the second dot with the second printing element at a second location on the substrate.

15 Claims, 7 Drawing Sheets

INK JET PRINTING METHOD AND PRINTER

CROSS-REFERENCE TO RELATED APPLICATIONS

This application is a Continuation of International Application No. PCT/EP2012/069919, filed on Oct. 9, 2012, and for which priority is claimed under 35 U.S.C. §120. PCT/EP2012/069919 claims priority under 35 U.S.C. §119(a) to Application No. 11185928.6, filed in Europe on Oct. 20, 2011. The entire contents of each of the above-identified applications are hereby incorporated by reference into the present application.

BACKGROUND OF THE INVENTION

1. Field of the Invention

The present invention relates to a method of printing dots of functional material with an inkjet printer at a plurality of intended positions on a substrate according to print data, said inkjet printer comprising a print head containing a plurality of printing elements for ejecting drops of functional material, each printing element characterized by a deviation angle at which a drop of functional material is ejected on the substrate, the method comprising the steps of deriving from the print data a first intended position of a first dot to be printed, determining a first printing element from the plurality of printing elements suitable for printing the first dot at the first intended position, printing the first dot with the first printing element at a first location on the substrate, deriving from the print data a second intended position of a second dot to be printed, determining a second printing element from the plurality of printing elements suitable for printing the second dot, and printing the second dot by the second printing element at a second location on the substrate.

2. Description of Background Art

An inkjet printer may be used to print an image of functional material on a substrate. Such a functional material may be a marking material like ink or another kind of functional material like metal or silicon. Drops of functional material are ejected by a plurality of printing elements of a print head of the inkjet printer on a substrate. The ejected functional material may form an image of dots of functional material like an image of pixels of ink or a mask for a solar cell. Even a three-dimensional image may be printed.

The print head and the substrate are moved relative to one another in at least two directions, for example a main scanning direction and a sub-scanning direction, in such a manner that a location on the substrate determined for a dot of the image according to the digital data is exposed to at least one printing element of the print head.

In industrial applications, images may be printed by means of screen printing which is a very old but renewed printing technique which is widely used for printing structures. A size of an image to be printed in the range of 100 micrometer to 200 micrometer may be achieved by screen printing. Such an image consists of image elements which have to be printed accurately with specified sizes and specified distances for the gaps between the image elements. A gap between two adjacent image elements is typically in the range of 100 micrometer to 200 micrometer wide.

In industrial applications, an image like a solar cell may be printed directly by ejecting metal containing functional material on a substrate in order to create a metal contact as a feature of the solar cell. Solar cell features printed in this way usually have a width larger than 100 micrometer.

However, various applications require even smaller sizes for gaps between adjacent image elements. This can hardly be done by application of screen printing due to throughput and required aspect ratios.

Inkjet technology may be used to produce adjacent image elements with a gap of a smaller size.

Structures with linear features may be more efficient when the width of the linear feature is reduced. For example, instead of directly printing the front-end metal contacts of a solar cell by means of screen printing, at first a mask is printed by an inkjet printer on a solar cell substrate. This masked substrate comprising printed image elements is etched and afterwards the etched parts are plated to create the metal contacts. Using this process, makes it possible to create contacts which are smaller than 100 micrometer, if the gap between the corresponding adjacent printing elements is smaller than 100 micrometer. The smaller the contact is, the larger the area of the solar cell for catching light rays is. In other words, the smaller the contacts on a solar cell, the larger the efficiency of the solar cell may be.

However, every printing element of a print head of an inkjet printer is produced according to specifications with corresponding tolerance ranges. The specifications and the corresponding tolerance ranges may be stored in a control unit of the inkjet printer. They may be stored as a list of characteristics for a standard printing element. A specification may be, for example, an angle of ejection of 0 radians and a maximum angle of deviation of ejecting the functional material, typically up to $\pi/180$ radians.

On the other hand, such a specification may also be determined by printing a test pattern that is scanned, resulting in a digital image. By means of the digital image, a characteristic of each printing element like an angle of ejection may be individually determined.

When opposite edges of two adjacent image elements of an image are produced by printing elements having a deviation between 0 radians and $\pi/180$ radians, a distance of a gap between the opposite edges may significantly vary. Such a variation in distance between two opposite edges of the image elements due to the maximum of $\pi/180$ radians in the angle of deviation may be unacceptable, since image elements may make contact while they are intended to leave a gap between the isolated image elements. On the other hand, an outcome of printing parallel printing elements at a mask for a solar cell may be a plurality of parallel printing elements that are spaced at different distances. Such a variety of distances does not lead to a maximum yield of the solar cell due to localization effects like overheating of a conducting part of the solar cell.

SUMMARY OF THE INVENTION

It is an object of the present invention to print at least two dots that have positions on the substrate that are specified by the digital data with a distance between the dots that is lower than a tolerated distance.

This object is achieved by a method according to the present invention, wherein the method of printing the dots at the plurality of intended positions on the substrate is according to at least one tolerated deviation for at least one distance between intended positions and comprises the step of retrieving a tolerated deviation for a distance between the first intended position and the second intended position, and determining the second printing element from the plurality of printing elements suitable for printing the second dot based on the tolerated deviation.

By experiments, it is established that the majority of drops ejected from a particular printing element have the same deviation angle. By printing the first dot with the first printing element and selecting the second printing element such that the expected deviation of the actual distance between the location of the first dot and the location of the second dot is within the tolerated deviation of the distance between the first intended position and the second intended position, the distance between the locations of the two dots will be according to the intended positions derived from the print data.

According to an embodiment, the method comprises a step of determining a range of possible distances between the first location and the second location and the step of determining the second printing element is further based on the determined range. When such a range is determined, the second printing element is determined on the basis of the tolerated deviation in combination with possible distances between the first location and the second location. This is advantageous for reducing the possible candidates of printing elements for selection as the second printing element.

According to an embodiment, the second printing element is determined such that the determined range is compatible with the tolerated deviation. The determined range is compatible with the tolerated deviation if the range is included in a range of possible distances between the first intended position and the second intended position according to the tolerated deviation.

According to an embodiment, the step of determining the range comprises a step of estimating the second location by means of the deviation angle of the second printing element, the second intended position, a distance between the second printing element and the substrate, and a relative velocity of the print head with respect to the substrate.

Since the second dot has not yet been printed on the substrate, the second location on the substrate is not yet known and has to be estimated. An accurate estimation is achieved by taking the deviation angle of the second printing element, the second intended position, a distance between the second printing element and the substrate, and a relative velocity of the print head with respect to the substrate into account.

According to an embodiment, the step of determining the range comprises a step of scanning the first location on the substrate with a scanner of the inkjet printer.

The scanner of the inkjet printer may be mounted in the environment of the print head and scans an area on the substrate in which the first dot is intended to be printed on the substrate according to the print data. The location of the first dot is detected within the area and is further mentioned as the first location. The scanned first location is used when the range is determined.

According to an embodiment, the step of determining the range comprises a step of estimating the first location by means of the deviation angle of the first printing element, the first intended position, the distance between the first printing element and the substrate and a relative velocity of the print head with respect to the substrate. This is advantageous if the inkjet printer does not include a scanner for the purpose of scanning dots on the substrate. The estimated first location is used when the range is determined.

According to an embodiment, the second printing element is determined to be equal to the first printing element. A step of determining the location of the first dot on the substrate may be skipped. Since the majority of drops ejected by the first printing element have the same deviation angle, the expected distance between the location of the first dot on the substrate and the location of the second dot on the substrate is according to the print data. This embodiment is advantageous if the deviation angles of the printing elements of the print head are unknown to the inkjet printer. The embodiment is also advantageous if the tolerated deviation is equal to zero.

According to an embodiment, the tolerated deviation is retrieved from a control unit of the inkjet printer. The configuration of the print head of the inkjet printer may predetermine the tolerated deviation. A predetermined tolerated deviation may be stored in a memory of the control unit.

The tolerated deviation may also be part of the print data. The print data usually arrives at the inkjet printer via a network connection. The print data may be stored in memory of the control unit or in a separate memory in the inkjet printer. The tolerated deviation is retrieved from the print data.

According to an embodiment, the method steps are repeated for a plurality of pairs of a first dot and a second dot. This is advantageous if the specifications according to the print data prescribe a distance for each pair of the first dot and the second dot. By doing so, pairs of the first dot and the second dot forming an image element like a line element, a solid element etc., may be printed according to the method.

According to an embodiment, for each of the plurality of pairs of dots, a first dot of the pair is part of an edge of a first image element of the image and a second dot of the pair is part of an edge of a second image element of the image. This is advantageous if the print data prescribe a distance for a dot of the plurality of first dots to a dot of the plurality of second dots. The edges may be an at least partially connected edge of a first image element of the image to be printed according to the print data. A one-to-one map may be defined between the plurality of first dots and the plurality of second dots and a distance between the dots of each pair may be determined according to the one-to-one map. This is advantageous if the mutual location of the edges on the substrate is crucial for the function of the image to be printed.

According to an embodiment, the edge of the first image element is opposite and parallel to the edge of the second image element. For each opposite pair of dots, the intended distance is the same. Moreover, the tolerated deviation for each opposite pair may be the same. Under at least one of these conditions, the achieved distance between the parallel and opposite edges printed on the substrate becomes very accurate with respect to the intended distance and lies within the tolerance range intended for the two edges.

According to an embodiment, the first image element and the second image element are part of a mask for producing a solar cell. Such an image element of a mask for producing a solar cell may be a counter part for a feature of the solar cell produced by means of the mask. For such a feature, very precise, small widths may be specified. The accuracy of the width of such a feature depends on the accurate distance between edges of image elements of the mask, which image elements form a counter part of the feature of the solar cell. Such an accurate distance between edges of the image elements of the mask is guaranteed when applying the method according to the present invention.

The present invention also comprises an inkjet printer comprising a control unit that is configured to execute any of the embodiments of the method according to the present invention.

The present invention also comprises a non-transitory computer readable medium comprising programs to execute any of the embodiments of the method according to the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
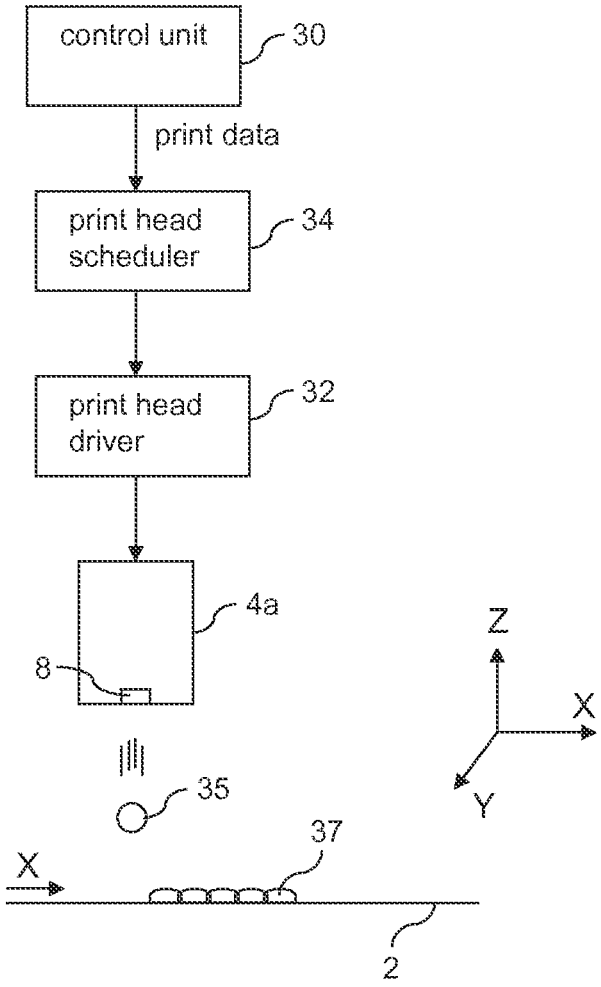
FIG. 1 is a schematic view of components of an inkjet printer for executing the method according to the present invention.

The present invention will now be described with reference to the accompanying drawings, wherein the same or similar elements are identified with the same reference numeral.

FIG. 1 is a schematic view of components of an inkjet printer according to a shown XYZ orientation. The inkjet printer comprises a control unit 30, a print head 4*a*, a print head driver 32 and a print head scheduler 34.

A substrate 2, e.g. a sheet of paper, a wafer, a transparent material, copper clad, aluminium, polytetrafluoroethylene, indium tin oxide or silicon nitride, is moved in a first direction of the arrow X by means of a transport mechanism that has not been shown. A print head 4*a* having a plurality of printing elements 8 is disposed above the path of the substrate 2 and extends over at least a part of the width of the substrate 2 (in the direction normal to the plane of the drawing in FIG. 2). As is generally known in the art, the printing elements 8 have actuators configured to cause the printing elements to eject droplets 35 of functional material onto the substrate 2 in a direction opposite to a direction indicated with the arrow Z, so as to print an image composed of dots 37 in accordance with print data supplied into the print head 4*a* by a control unit 30 of the inkjet printer. The printing elements 8 are arranged in one or more lines along the width of the substrate 2. According to FIG. 1, the width of the substrate 2 is in a direction Y, pointing out of FIG. 1, perpendicular to the first direction X and perpendicular to the opposite direction of a direction Z as indicated in FIG. 1. The printing elements 8 are in a certain raster on the print head 4*a*, which defines among other things the print resolution. Within the raster, a dot 37 may be formed in any width wise location on the substrate 2. The locations of the dots 37 on the substrate in the first medium transport direction X are determined by the timings with which the individual printing elements are fired when substrate 2 moves past the sprint head 4*a* and is also dependent on the position of a firing printing element in the raster on the print head 4*a*. To move the substrate 2 past the print head 4*a* is in particular advantageous if the print head 4*a* is of a significant mass. In an alternative embodiment, the print head 4*a* moves past the substrate 2. This is advantageous if a needed accurate movement of the print head 4*a* can be achieved while a same accurate movement of the substrate 2 cannot be guaranteed.

In case of a color printer, besides the print head 4*a*, the other print heads 4*b*, 4*c*, 4*d*, etc. will include a suitable array of printing elements 8 for other colors.

Print data that specify the image to be printed are supplied to a print head driver 32, which causes the individual printing elements 8 of the print head 4*a* to fire at appropriate timings. By way of example, it may be assumed that the printing elements 8 or their actuators are capable of firing synchronously with a certain frequency, so that a pixel line of dots 37 is formed on the substrate 2 in each cycle forming an edge or an internal line of a linear printing element of the image to be printed. However, other printing strategies may be applied.

In the example shown, the print data is supplied to a print head scheduler 34, which specifies for each operating cycle of the print head 4*a* the printing elements 8 that have to be actuated. Instruction signals are sent from the print head scheduler 34 to the print head driver 32, so that the image that is actually printed with the print head 4*a* consists of dots specified by the print data. For convenience reasons, distances on the substrate 2 mentioned hereinafter may be mentioned without the distance unit micrometer.

Figure 2A:
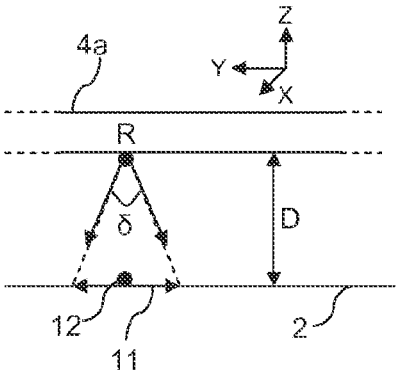
FIGS. 2A-2G are schematic views of printing dots according to the present invention.

FIG. 2A is a schematic side view of a print head 4*a* according to the shown XYZ orientation. The print head 4*a* comprises a printing element R representing a reference printing element for the plurality of printing elements of the print head 4*a*. The printing element R may eject drops of functional material on a substrate 2 under an angle having an absolute value that varies from 0 radians to $\delta/2$ radians. The substrate 2 has a distance D towards the print head 4*a*. The drop ejected from the printing element may hit the substrate 2 in a range 11 having a radius r equal to $D*\sin(\delta/2)$. In an ideal case that the angle equals 0 radians, the drop will hit the substrate in a location 12 vertical under the printing element R in the opposite direction of the Z direction. For convenience reasons, the velocity of the substrate 2 under the print head 4*a* is assumed to be negligible with respect to the distance D. If the velocity of the substrate 2 under the print head 4*a* is not negligible, the steps of the method are easily adapted taking the velocity of the substrate 2 under the print head 4*a* into account. The absolute angle range from 0 radians to $\delta/2$ radians belongs to the characteristics of a printing element of the print head 4*a*.

Figure 2B:
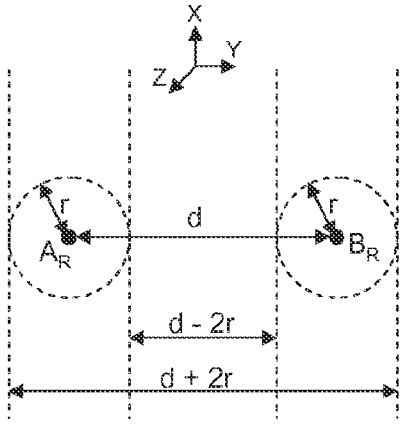

FIG. 2B is a schematic top view of a part of the substrate 2 according to the shown XYZ orientation. A first drop and a second drop are ejected from the print head 4*a* resulting in a first dot $A_R$ and a second dot $B_R$, respectively on the substrate 2. The first dot $A_R$ and the second dot $B_R$ should have a first intended position and a second intended position, respectively according to the print data such that there is a distance d between the first intended position and the second intended position. The absolute angle range from 0 radians to $\delta/2$ radians as shown in FIG. 2A defines possible actual ranges for a distance between a location of the first dot $A_R$ on the substrate 2 and a location of the second dot $B_R$ on the substrate 2 varying from a range with a minimum distance $d-2r$ to a range with a maximum distance $d+2r$ as indicated in FIG. 2B. The possible actual ranges are derivable from characteristics of a print element of the print head 4*a*. The characteristics may be determined before printing or on regular time intervals during printing of images by the print head 4*a*.

The nominal distance d between the first dot $A_R$ and the second dot $B_R$ is specified in the print data, for example a Euclidean distance derived from coordinates of the first dot $A_R$ and the second dot $B_R$. Also, a tolerated deviation from the nominal distance between the first dot $A_R$ and the second dot $B_R$ is specified in the print data.

In a first case, the first dot $A_R$ is ejected by a first printing element and the second dot $B_R$ is ejected by a second printing element, and the nominal distance d based on the print data plus or minus a deviation due to the deviation angle of the first printing element and plus or minus a deviation due to the deviation angle of the second printing element varies between the nominal distance plus or minus the tolerance deviation. Then, the expected actual distance between the first dot $A_R$ and the second dot $B_R$ meets the specifications of the print data. The first dot $A_R$ and the second dot $B_R$ may be printed by arbitrary selected printing elements from the print head 4*a*.

In a second case, the first dot $A_R$ is ejected by a first printing element and the second dot $B_R$ is ejected by a second printing element, and the nominal distance d based on the print data plus or minus a deviation due to the deviation angle of the first printing element and plus or minus a deviation due to the deviation angle of the second printing element is smaller than the nominal distance minus the tolerance deviation or larger than the nominal distance plus the tolerance deviation. Then, the expected actual distance between the first dot $A_R$ and the second dot $B_R$ does not meet the specifications of the print data.

Figure 2C:
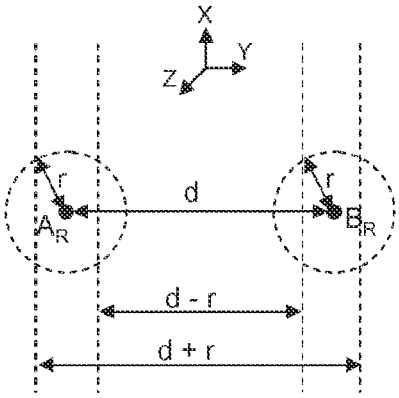

For example, a tolerance range of the nominal distance is from d−r to d+r. Such a tolerance range is shown in FIG. 2C. Then, the first dot $A_R$ and the second dot $B_R$ should not be printed by arbitrary selected printing elements from the print head 4*a*, because the distance between the dots $A_R$, $B_R$ may be lying in a first sub-range from d−2r to d−r or in a second sub-range from d+r to d+2r. The first sub-range and the second sub-range are outside the tolerance range from d−r to d+r of the nominal distance. This incompatibility is overcome by applying the method according to the present invention.

Figure 2D:
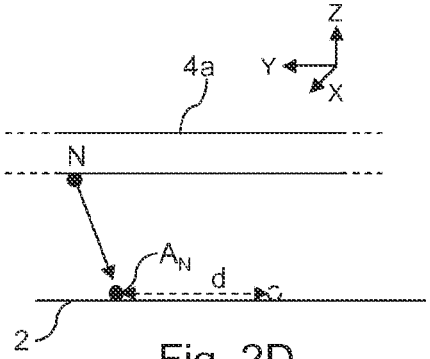

FIG. 2D illustrates a first printing element N of the print head 4*a* ejecting a drop resulting in a first dot $A_N$ on the substrate 2. Since the first printing element N has a deviation angle for a route between the printing element opening and the substrate 2, the first dot $A_N$ does not hit the substrate 2 at a vertical position under the printing element N.

A nominal distance d between an intended position of the expected location of the first dot $A_N$ and an intended position of the expected location of a planned second dot $B_M$ is indicated by a double-sided arrow.

A first location of the first dot $A_N$ on the substrate is to be determined. The determination may be a calculation of the first location of the first dot $A_N$ based on the intended position of the first dot $A_N$ and the angle of deviation of the first printing element N. In an alternative embodiment, the first actual position of the first dot $A_N$ is determined by a scanner or camera, for example mounted on the print head. The scanner or camera searches for the first dot $A_N$ on the substrate in the environment of a location on the substrate 2 according to the intended position. As shown in FIG. 2D, the printing element N has a substantial deviation angle.

In order to print the second dot $B_M$, the suitability of each printing element to print the second dot $B_M$ is analyzed. A maximum deviation X of a distance between an expected location of the second dot $B_M$ intended to be ejected and the location of the first dot $A_N$ is determined for each printing element. The determination is based on a deviation angle of the printing element, a distance between the first intended position of the first dot $A_N$ and the first location of the first dot $A_N$ and a tolerated deviation on a distance between the first intended position of the first dot $A_N$ and the second intended position of the second dot $B_M$.

A printing element is suitable to eject the second dot $B_M$, if the distance between the determined position of the first dot $A_N$ and the expected position of the second dot $B_M$ based on the intended position of the second dot $B_M$ according to the print data and the deviation angle of the printing element is less than a tolerated distance d+r and more than a tolerated distance d−r. The tolerated distance range [d−r, d+r] may be included in the print data.

Figure 2E:
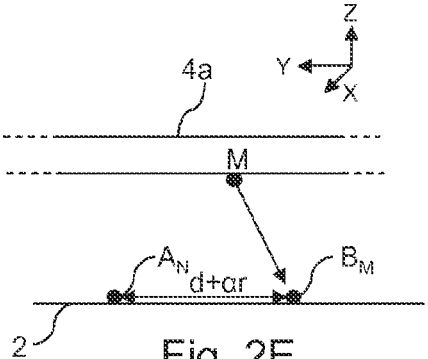

Another drop is ejected by a suitable second printing element M as shown in FIG. 2E. The second drop hits the substrate 2 resulting in a second dot $B_M$. By the selection of the second printing element M according to the method of the present invention, the first dot $A_N$ and the second dot $B_M$ are, in this case, distanced at a distance $d+\alpha r$, wherein $\alpha$ is a real number between −1 and 1. The distance $d+\alpha r$ between the first dot $A_N$ and the second dot $B_M$ is compatible with the tolerance range [d−r, d+r] according to the print data.

Figure 2F:
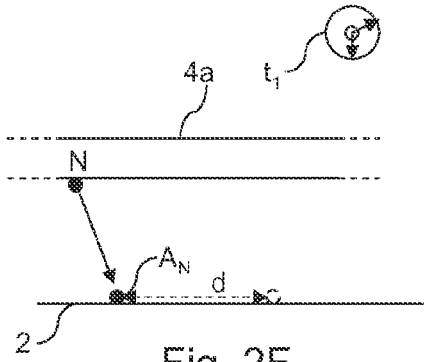
Figure 2G:
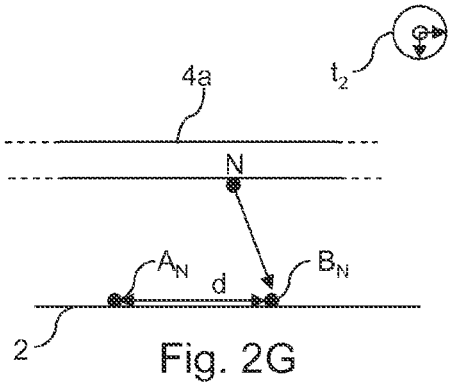

A specific embodiment is shown in FIGS. 2F-2G. The second printing element M is the same as the first printing element N. The first printing element N is always suitable for printing the second dot $B_M$ since the first and second dot are printed with the same deviation angle of printing element N. Since M equals N the second dot is represented in FIG. 2G by the indication $B_N$.

FIG. 2F shows the printing element N of the print head 4*a* ejecting a drop at a first time $t_1$ resulting in a first dot $A_N$ on the substrate 2. Since the printing element N has a deviating angle for the ejection route, the first dot $A_N$ does not hit the substrate 2 at a vertical position under the printing element N. At a second time $t_2$ after the first time $t_i$, a second drop is ejected by the same printing element N as shown in FIG. 2G. The second drop hits the substrate 2 resulting in a second dot $B_N$. Since the same printing element N has ejected the first and second drop, the angle of deviation for the second drop is in all probability the same as the angle of deviation for the first drop. Since the angle of deviation for the first and second drop is assumed to be the same, the first dot $A_N$ and the second dot $B_N$ are assumed to be distanced at a distance d. Therefore the distance between the first dot $A_N$ and the second dot $B_N$ lies inside the tolerance range [d−r, d+r] according to the print data.

Figure 3A:
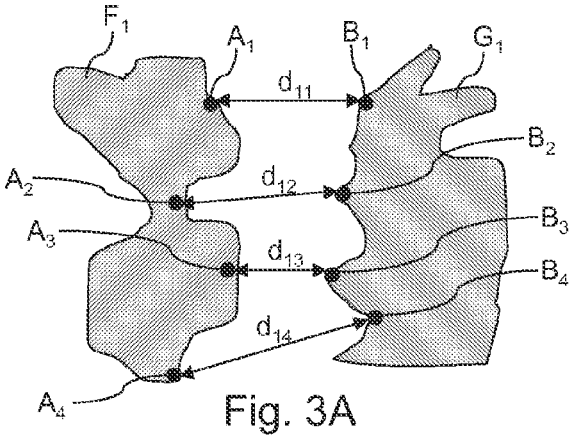
FIGS. 3A-3C are schematic views of printing image elements according to the present invention.

FIG. 3A shows another embodiment of the method according to the present invention. The image to be printed comprises a first image element $F_1$ and a second image element $G_1$. The first image element $F_1$ comprises a first hedged area enclosed by a first edge. The first edge comprises a number of locations $A_1$, $A_2$, $A_3$, $A_4$. The second image element $G_1$ comprises a second hedged area enclosed by a second edge. The second edge comprises a number of locations $B_1$, $B_2$, $B_3$, $B_4$. The print data for the image specifies a distance $d_{11}$ between the location $A_1$ and the location $B_1$, a distance $d_{12}$ between the location $A_2$ and the location $B_2$, a distance $d_{13}$ between the location $A_3$ and the location $B_3$ and a distance $d_{14}$ between the location $A_4$ and the location $B_4$.

The print data for the image also comprises a first tolerance range for the distance $d_{11}$ between the location $A_1$ and the location $B_1$, a second tolerance range for the distance $d_{12}$ between the location $A_2$ and the location $B_2$, a third tolerance range for the distance $d_{13}$ between the location $A_3$ and the location $B_3$ and a fourth tolerance range for the distance $d_{14}$ between the location $A_4$ and the location $B_4$.

According to the method of the present invention the dot on the location $A_1$ is to be printed by a first printing element of the print head 4*a* and a second printing element is to be selected to print the dot on the location $B_1$ such that the distance between the dot printed by the first printing element and the second dot printed by the second printing element on the substrate is expected to be within the first tolerance range for the distance $d_{11}$ between the location $A_1$ and the location $B_1$.

When no such second printing element, being different from the first printing element, can be selected, the second printing element may be selected identical to the first printing element analogous to the situation shown in FIGS. 2F-2G.

The same steps may be applied for the dot on location $A_i$ and the dot on location $B_i$ in combination with the i-th tolerance range for the distance $d_{1i}$ between the location $A_i$ and the location $B_1$., where i=2, 3, 4.

It is noted that the distances $d_{11}$, $d_{12}$, $d_{13}$, $d_{14}$ are different with respect to length and orientation. In general, pairs of locations forming the complete opposite parts of the edges of the first image element $F_1$ and a second image element $G_1$ may have different distances.

In another embodiment, tolerance ranges for a number of locations on the first edge, which form a continuous part of the first edge and tolerance ranges for a number of corresponding locations on the second edge are defined in the print data. Then, the dots to be printed on the number of locations on the continuous part may be printed by a same first printing element and the dots to be printed on the corresponding locations on the second edge may be printed by a second printing element of the print head 4*a*, which is selected according to the method of the present invention. The corresponding locations on the second edge may also form a continuous part of the second edge. If no second printing element can be selected, all dots to be printed on the number of locations on the continuous part and all the dots to be printed on the corresponding locations on the second edge may be printed by a same first printing element of the print head 4*a*.

Figure 3B:
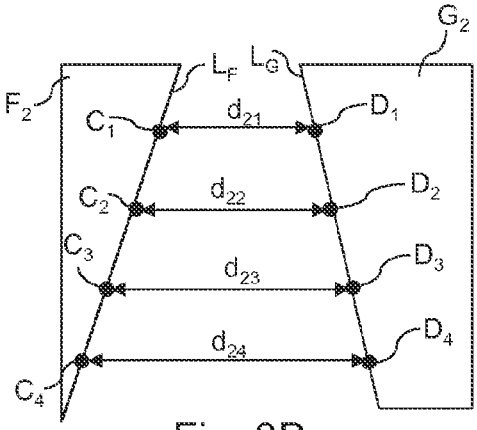

FIG. 3B shows another embodiment of the method according to the present invention. The image to be printed comprises a first image element $F_2$ and a second image element $G_2$. The first image element $F_2$ comprises a first triangular area enclosed by three line pieces. A first line piece $L_F$ comprises a number of locations $C_1$, $C_2$, $C_3$, $C_4$. The second image element $G_2$ comprises a second triangular area enclosed by three line pieces. A second line piece $L_G$ of the three line pieces, which enclose the second triangular area, comprises a number of locations $D_1$, $D_2$, $D_3$, $D_4$. Besides the locations $C_1$, $C_2$, $C_3$, $C_4$ at the first image element $F_2$ and the locations $D_1$, $D_2$, $D_3$, $D_4$ at the second image element $G_2$, the print data for the image also comprises a first tolerance range for a distance $d_{21}$ between the location $C_1$ and the location $D_1$, a second tolerance range for a distance $d_{22}$ between the location $C_2$ and the location $D_2$, a third tolerance range for a distance $d_{23}$ between the location $C_3$ and the location $D_3$ and a fourth tolerance range for a distance $d_{24}$ between the location $C_4$ and the location $D_4$.

According to the method of the present invention, the dot on the location $C_1$ is to be printed by a first printing element of the print head 4*a* and a second printing element is to be selected to print the dot on the location $D_1$ such that the distance between the dot printed by the first printing element and the second dot printed by the second printing element on the substrate is expected to be within the first tolerance range for the distance $d_{21}$ between the location $C_1$ and the location $D_1$.

When no such second printing element, being different from the first printing element, can be selected, the second printing element may be selected identical to the first printing element analogous to the situation shown in FIGS. 2F-2G.

The same steps may be applied for the dot on location $C^i$ and the dot on location $D^i$ in combination with the i-th tolerance range for the distance $d_{2i}$ between the location $C_i$ and the location $D_i$., where i=2, 3, 4.

It is noted that the distances $d_{21}$, $d_{22}$, $d_{23}$, $d_{24}$ are different with respect to length but are equal with respect to orientation. In an embodiment, pairs of locations forming the complete opposite parts of the edges of the first image element $F_1$ and a second image element $G_1$ may have an orientation that is equal to the direction of the width of the substrate indicated as direction Y in FIG. 2D.

In another embodiment, tolerance ranges for a number of locations on the first line piece $L_F$, which form a continuous part of the first line piece $L_F$, and tolerance ranges for a number of corresponding locations on the second line piece $L_G$ are defined in the print data. Then, all dots to be printed on the number of locations on the continuous part may be printed by a first printing element and all dots to be printed on the corresponding locations on the second line piece $L_G$ may be printed by a second printing element of the print head 4*a*, which is selected according to the method of the present invention. If no second printing element can be selected, all dots of the continuous part of the first line piece $L_F$ and all dots of the corresponding part of the second line piece $L_G$ may be printed by the same first printing element. The corresponding locations on the second line piece $L_G$ may also form a continuous part of the second line piece $L_G$. Moreover, the continuous part may be the whole first line piece $L_F$. Also, the corresponding locations on the second line piece $L_G$ may be the whole second line piece $L_G$. The image elements $F_2$, $G_2$ have a triangular shape and a four-sided shape, respectively. The method according to the present invention is also applicable to any other area enclosed by line pieces or any other area having an enclosing edge.

Figure 3C:
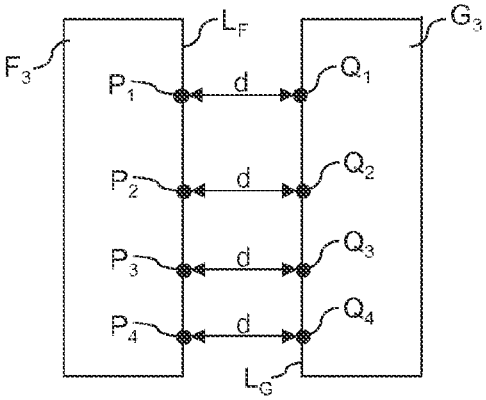

FIG. 3C shows another embodiment of the method according to the present invention. The image to be printed comprises a first image element $F_3$ and a second image element $G_3$. The first image element $F_3$ comprises a first rectangular area enclosed by four line pieces. A first line piece $L_F$ comprises a number of locations $P_1$, $P_2$, $P_3$, $P_4$. The second image element $G_3$ comprises a second rectangular area enclosed by four line pieces. A second line piece $L_G$ of the four line pieces which enclose the second rectangular area comprises a number of locations $Q_1$, $Q_2$, $Q_3$, $Q_4$. The first line piece $L_F$ of the first image element $F_3$ and the second line piece $L_G$ of the second image element $G_3$ are opposite and parallel. The print data for the image comprises a same tolerance range for a same distance d between the location $P_1$ and the location $Q_1$, between the location $P_2$ and the location $Q_2$, between the location $P_3$ and the location $Q_3$ and between the location $P_4$ and the location $Q_4$.

The first printing element for printing of dots on the locations $P_1$, $P_2$, $P_3$, $P_4$ and the second printing element for printing of dots on the locations $Q_1$, $Q_2$, $Q_3$, $Q_4$ may be selected according to the present invention. If no second printing element different from the first printing element can be selected, all the dots on the locations $P_1$, $P_2$, $P_3$, $P_4$, $Q_1$, $Q_2$, $Q_3$, $Q_4$ may be printed by the same first printing element.

In an alternative embodiment, the first printing element and second printing element are both selected from the plurality of printing elements in order to meet an intended distance derived from the first intended position and the second intended position and an intended tolerance range derived from the corresponding tolerated deviation.

When the intended tolerance range according to the print data is incompatible with a tolerance range derived from the characteristics from a reference printing element of the print head 4*a*, the dots on the locations $P_1, Q_1, P_2, Q_2, P_3, Q_3, P_4, Q_4$ may be printed by a same printing element of the print head 4*a*.

It is noted that the distances d are equal with respect to length and orientation. The pairs of locations forming the complete opposite parallel parts of the edges of the first image element $F_3$ and a second image element $G_3$ have an orientation that is equal to the direction of the width of the substrate indicated as direction Y in FIG. 2D. This is advantageous, since the print head can move in the direction X according to FIG. 2D along the first line piece $L_F$ using only one printing element suitable according to the method of the present invention to print the complete first line piece $L_F$ and along the second line piece $L_G$ also using only one printing element suitable according to the method of the present invention to print the complete second line piece $L_G$.

Figure 4A:
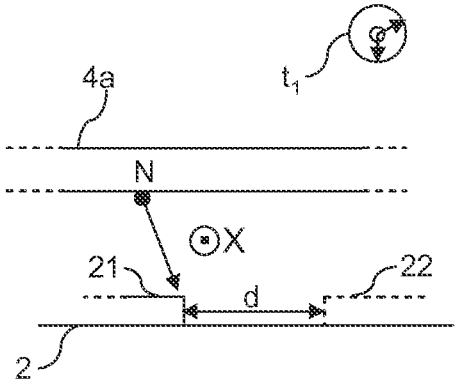
FIG. 4A-4F are schematic views of printing adjacent linear image element according to the present invention.
Figure 4B:
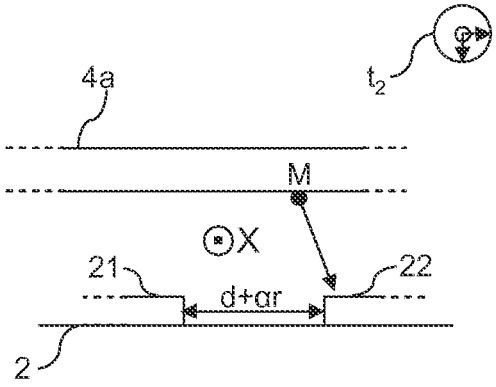
Figure 4E:
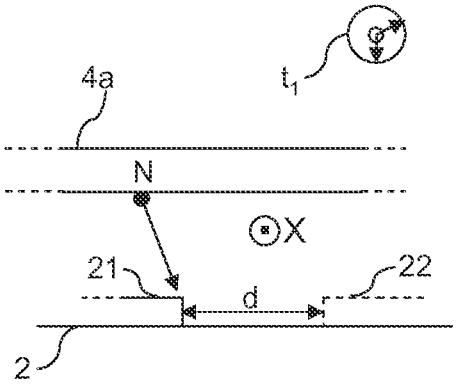
Figure 4F:
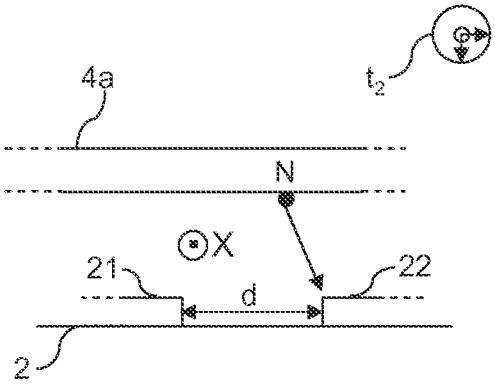
Figure 4G:
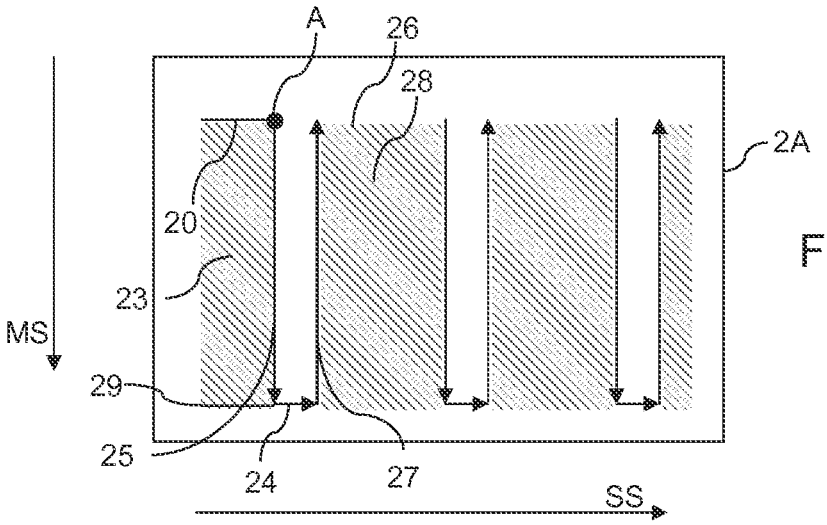
FIG. 4G illustrates a relative movement of the print head towards the substrate when printing adjacent linear image elements according to the present invention.
Figure 4C:
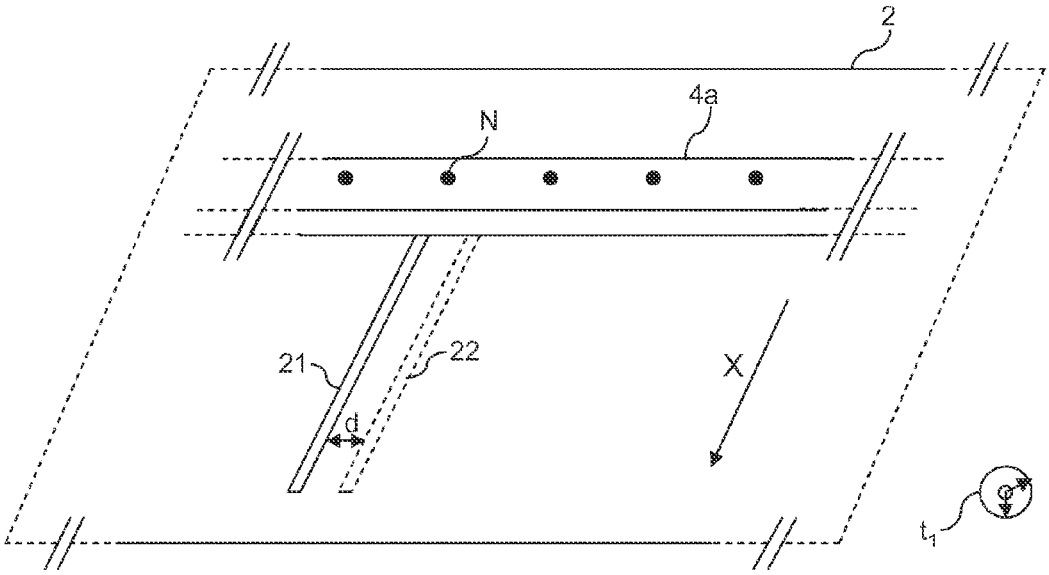
Figure 4D:
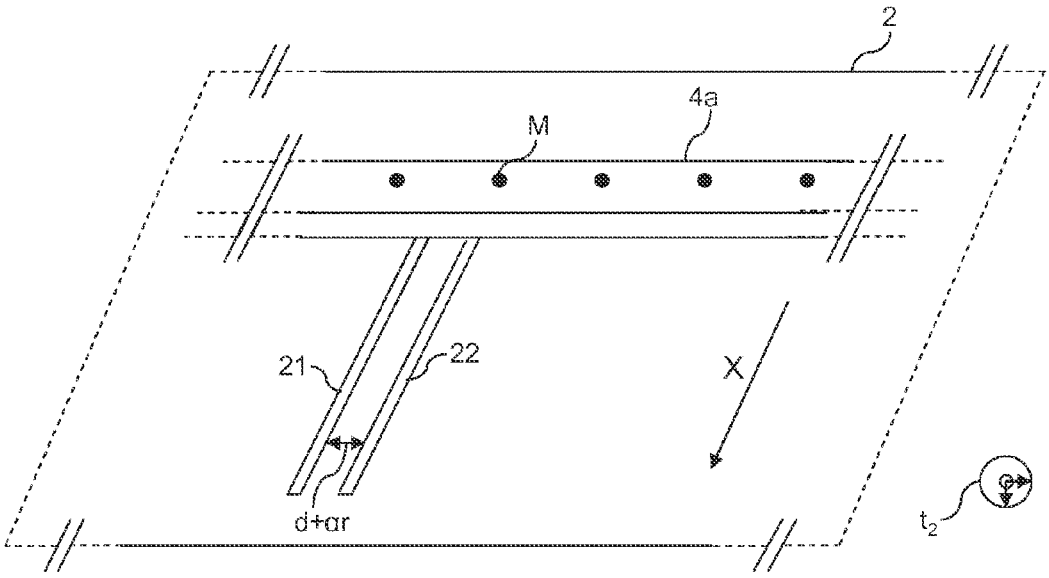

FIGS. 4A and FIG. 4C show a first image element 21 being printed at a first moment in time $t_i$. FIGS. 4B and FIG. 4D show a second image element 22 being printed at a second moment in time $t_2$ later than the first moment in time $t_1$.

The right edge of the first image element 21 is printed by a first printing element N at the first moment in time $t_1$. Then, locations of the dots forming the right edge of the first image element 21 are determined. Then, a second printing element M is selected such that the expected distance between the already printed right edge of the first image element 21 and the left edge of the second image element 22 is within the tolerance range specified according to the print data. In this case, the tolerance range is equal to [d−r, d+r]. Then, the right edge of the second image element 22 is printed by the second printing element M, which may have an angle of deviation meeting the conditions of the intended distance d and the tolerance range [d−r, d+r] for the distance d specified according to the print data. Despite any kind of angle of deviation of printing element N and printing element M, the distance between the right edge of the first linear image element 21 and the left edge of the second linear image element 22 is within the tolerance range for the intended distance d, namely $d+\alpha r$.

FIGS. 4E-4F show a specific example according to which the second printing element M is selected to be the same as the first printing element N. Then, the distance between the right edge of the first image element 21 and the left edge of the second image element 22 is expected to be equal to the intended distance d. It is noted that according to this embodiment, the location of the left edge of the first image element 21 need not be determined.

FIG. 4G elucidates a relative movement of the print head towards the substrate when printing adjacent linear image elements according to the present invention. FIG. 4G shows a part 2A of the substrate on which at least three linear hatched image elements 23, 28 are to be printed. A first image element 23 is printed by at least one printing element of the print head by moving the print head in a main scanning direction MS and in a sub-scanning direction SS in order to completely fill the first image element 23 until a right edge 25 of the first image element 23 is reached. The main scanning direction may be equal to the X direction in FIG. 2D, while the sub-scanning direction SS may be equal to the Y direction in FIG. 2D.

Such a complete filling of the first image segment 23 may be achieved by repeating for each column of dots of the first image element 23 to be printed a movement in the main scanning direction MS, a small movement in sub-scanning direction SS and a movement opposite to the main scanning direction MS. At a certain moment in time the print head has completed the first image element 23 except the right edge 25. The right edge 25 of the first image element 23 is intended to be printed by a first printing element N (not shown) by ejecting ink drops from the first printing element N.

For convenience, but non-limiting reasons, it is assumed that the first printing element N of the print head is positioned at an upper edge 20 of the first image element 23 at a starting point A for printing the right edge 25. In order to print the right edge 25, the print head is moved in the main scanning direction MS towards a lower edge 29 of the first image element 23. According to a previous embodiment of the present invention, a left edge 27 of a second image element 28 may be printed by a second printing element M selected according to the steps of the method according to the present invention. A movement of the print head in the sub scanning direction is applied such that the second printing element M resides above the substrate at which the left edge of the second image element 28 is intended to be printed according to the print data.

According to another previous embodiment, the second printing element M may also be the same as the first printing element N. FIG. 4G shows a sub-scanning step if the second printing element M is the same as the first printing element N.

After the first printing element N has completed the right edge 25 of the first image element 23, the print head makes a move in a sub-scanning direction SS according to an arrow 24. The distance moved in the sub-scanning direction SS is determined to be the distance between the right edge 25 of the first image element 23 and the left edge 27 of the second image element 28 as specified in the print data. The first printing element N is now in a position to print the left edge 27 of the second image element 28. To achieve this, the print head moves in the opposite direction of the main scanning direction MS towards a top edge 26 of the second image element 28. During the move of the print head in the opposite direction of the main scanning direction MS, the printing element N ejects ink drops in order to form the left edge 27 of the second image element 28. These movements may be repeated for remaining edges of image elements on the part 2A of the substrate.

Figure 5:
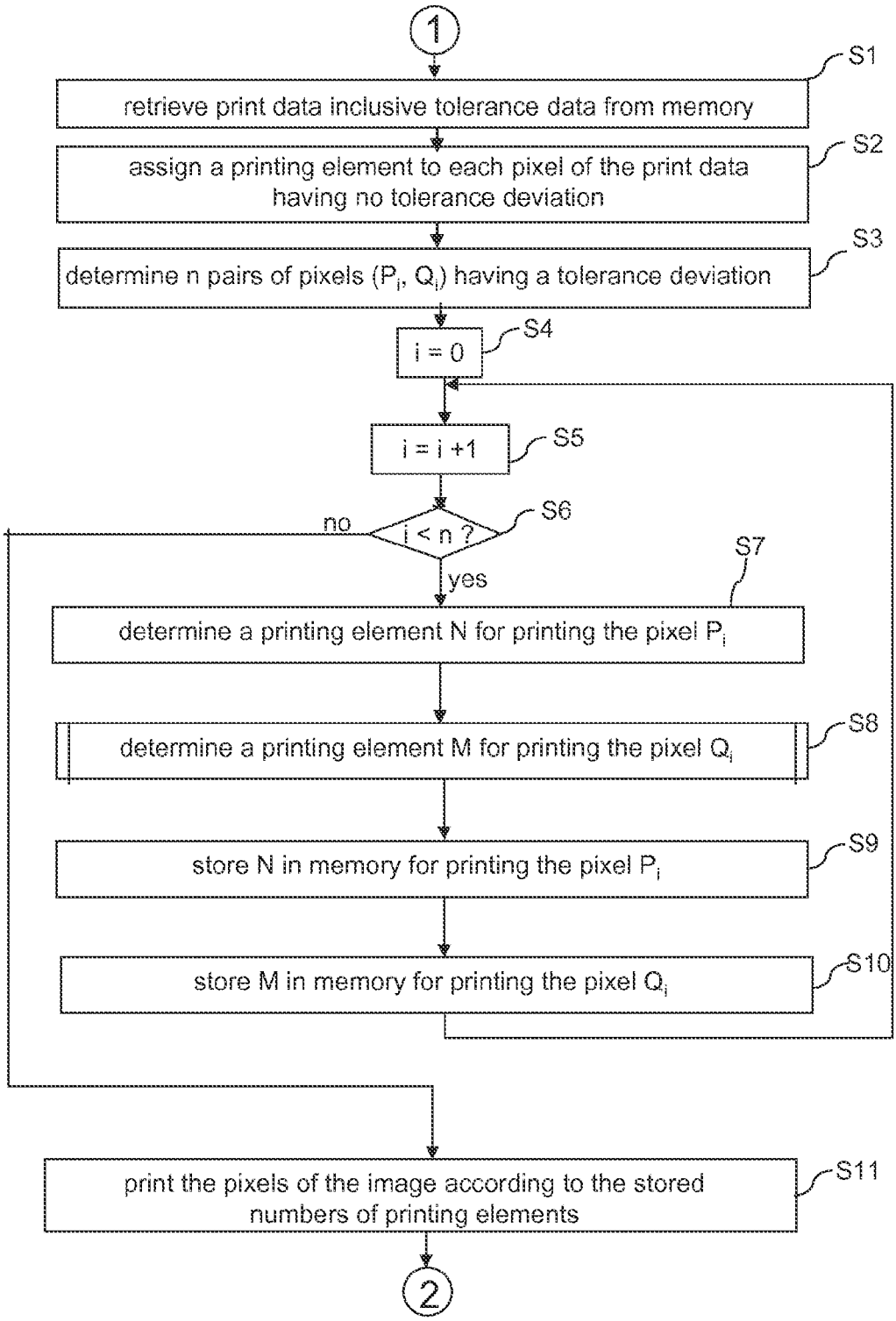
FIG. 5 is a flow diagram of steps of the method according to the present invention for printing a complete image with at least one image element.

FIG. 5 shows the steps of the method for printing a complete image with at least one image element as for example shown in FIG. 4G. Starting point 1 is a situation where print data including image data and tolerance data reside in memory of the inkjet printer.

According to a first step S1, print data inclusive tolerance data is retrieved from a memory of the inkjet printer. The print data comprises pixel values to be printed, for example a bitmap.

According to a second step S2, a printing element is addressed to each pixel of the bitmap, which has no tolerance data.

According to a third step S3, a number n of pairs of pixels (Pi, Qi) are determined from the print data and the tolerance data of which each pair has a tolerance deviation.

According to an initializing step S4, an index i is initialized at zero.

According to an incrementing step S5, the index i is increased by one.

According to a first decision step S6, it is checked if the index i is still smaller than the number n of determined pairs. If so, the i-th pair is further processed in subsequent steps S7-S10.

According to a first processing step S7, a printing element N for printing the pixel Pi is determined. The printing element N may be determined by taking the addressed printing element for pixel Pi in the second step S2.

According to a second processing step S8, a printing element M for printing the pixel Qi is determined. The printing element M is determined taking the tolerance deviation into account. This process step is further elucidated in FIG. 6.

According to a third processing step S9, the number N of printing element N for printing the pixel Pi is stored in memory. The printing element N is addressed to print pixel Pi.

According to a fourth processing step S10, the number M of printing element M for printing the pixel Qi is stored in memory. The printing element M is addressed to print pixel Qi.

By repeating the processing steps S7-S10, printing elements are addressed to all pixels to be printed.

According to a last step S11, the pixels of the image are printed by the printing elements according to the stored numbers of printing elements addressed to the pixels. End point 2 is reached as the image is printed according to the print data and also the tolerance data is taken into account.

Figure 6:
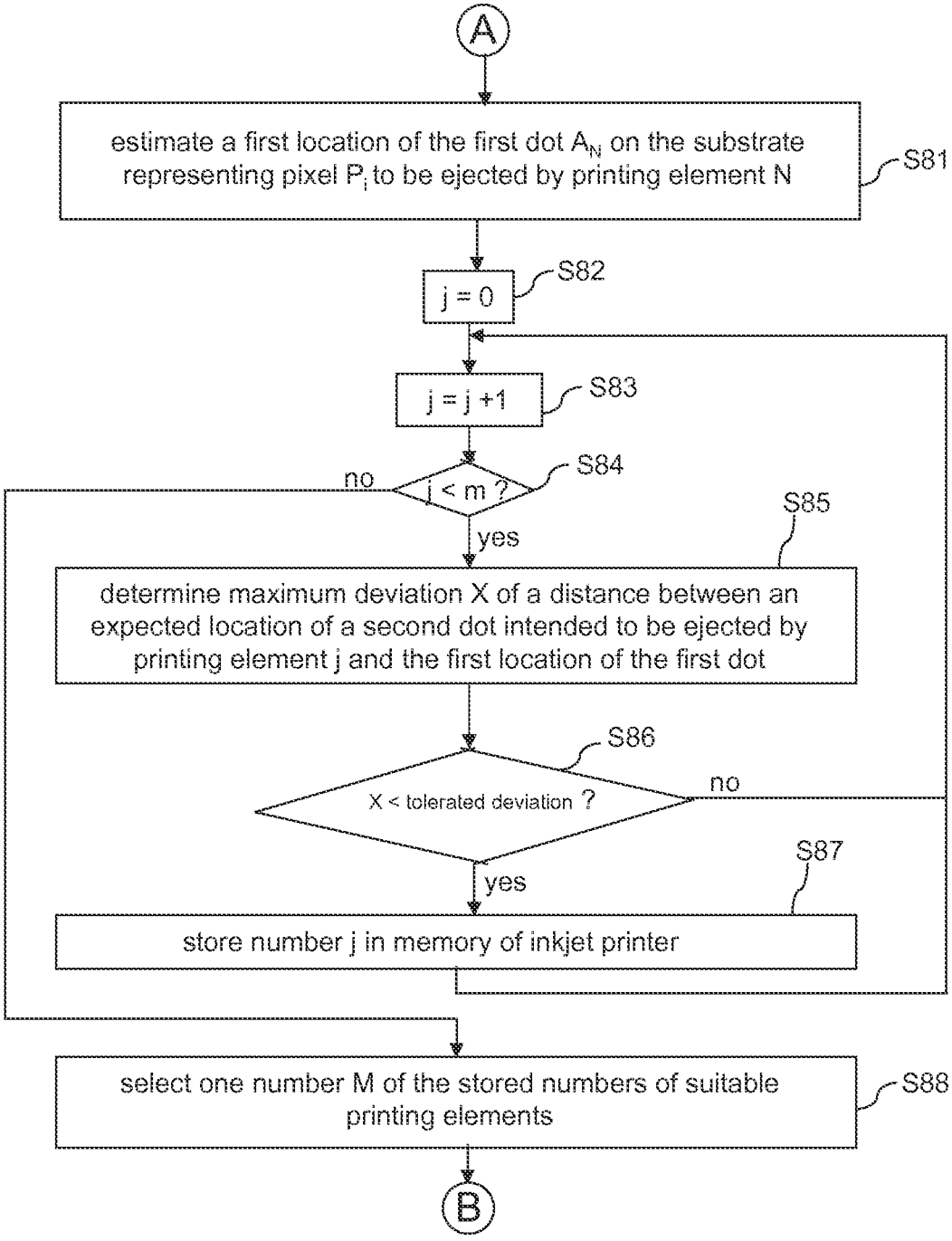
FIG. 6 is a flow diagram of steps of the method according to the present invention for determining a printing element for ejecting a dot according to tolerance data.

FIG. 6 further elucidates the processing step S8 of FIG. 5 with reference to FIG. 2D-2E. Starting Point A is arrived at when entering the processing step S8 of FIG. 5.

According to a first step S81, a first location of the first dot $A_N$ on the substrate is determined. The determination may be a calculation of the first location of the first dot $A_N$ based on the intended position of the first dot $A_N$ according to pixel Pi and the angle of deviation of the first printing element N.

In order to print the second dot $B_M$ the suitability of each printing element to print the second dot $B_M$ is analyzed. It is supposed that the plurality of printing elements is numbered from 1 to m.

At an initial step S82, an index j is initialized at zero.

At an incrementing step S83, the index j is increased by one.

At a first decision step S84, it is checked if the index j is still smaller than the maximum number m. If so, the j-th printing element is further analyzed in an investigating step S85. A maximum deviation X of a distance between an expected location of the second dot $B_M$ intended to be ejected by the j-th printing element and the location of the first dot $A_N$ is determined. The determination is based on a deviation angle of the j-th printing element, a distance between the first intended position of the first dot $A_N$ and the first location of the first dot $A_N$ and a tolerated deviation on a distance between the first intended position of the first dot $A_N$ and the second intended position of the second dot $B_M$.

In a second decision step S86, it is checked whether or not the maximum deviation X is less than the tolerated deviation. The j-th printing element is suitable to eject the second dot $B_M$, if the distance between the determined position of the first dot $A_N$ and the expected position of the second dot $B_M$ based on the intended position of the second dot $B_M$ according to the print data and the deviation angle of the second printing element is less than a tolerated distance d+r and more than a tolerated distance d−r. The tolerated distance range [d−r, d+r] may be included in the print data.

If the j-th printing element is suitable for ejecting the second dot $B_M$, the number j is stored in a memory of the inkjet printer in a next step S87.

In this way, all printing elements of the inkjet printer are investigated for suitability. It is noted that the amount of numbers of suitable printing elements stored in memory is always larger than zero, since the first printing element N will always be found suitable and therefore stored.

In a last step S88, a printing element M from the at least one printing element stored in memory is selected. The selection may be based on one of the difference between the maximum deviation X calculated for the printing element M and the tolerated deviation, the absolute value of the maximum deviation X calculated for the printing element M, the position of the printing element M on the print head with respect to the first printing element N, the relative position of the printing element M and the first printing element on the print head, and the relative position of the first dot $A_N$ and the second dot $B_M$.

An end point B of the steps S81-S88 is reached and the method according to FIG. 5 may proceed with the third processing step S9.

In an alternative embodiment, the first position of the first dot $A_N$ is determined after printing the first dot $A_N$. Such a determination may be achieved by scanning the substrate by a scanner or camera, for example mounted on the print head, which searches for the first dot $A_N$ on the substrate in the environment of a location on the substrate 2 according to the intended position for the first dot $A_N$. If the scanned location differs so much from the estimated location according to the first step of FIG. 6, such that the printing element addressed for the second dot $B_M$ is not suitable any more, another printing element may be determined at that moment that is still suitable for printing the second dot $B_M$ according to the print data and the tolerance deviation.

One of the here-above described embodiments of the method may be used for printing a mask, for instance for a production of a solar cell. A small distance between two parallel image elements on the mask has been established by experiment. Increased efficiency of a solar cell can be realized by reducing the line widths of front-side metal contacts. Instead of directly printing metal contacts by means of screen printing, at first a mask is ejected by an inkjet printer on a solar cell substrate according to the method of the present invention. The masked substrate is etched and afterwards the etched parts are plated to create the metal contacts. Using the method according to the present invention makes it possible to create small contacts of about 15 micrometer.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of printing dots of functional material with an inkjet printer at a plurality of intended positions on a substrate according to print data and at least one tolerated deviation for at least one distance between intended positions, the inkjet printer comprising a print head containing a plurality of printing elements for ejecting drops of functional material, each printing element characterized by a deviation angle from a Z direction perpendicular to the substrate, the deviation angle at which a drop of functional material is ejected from the print head on the substrate, wherein the method comprises the steps of:

deriving from the print data a first intended position of a first dot to be printed;

determining a first printing element from the plurality of printing elements suitable for printing the first dot at the first intended position;

printing the first dot with the first printing element at a first location on the substrate;

deriving from the print data a second intended position of a second dot to be printed;

retrieving a tolerated deviation of a distance between the first intended position and the second intended position;

determining a second printing element from the plurality of printing elements suitable for printing the second dot based on the tolerated deviation, the deviation angle of the first printing element and the deviation angle of the second printing element; and printing the second dot with the second printing element at a second location on the substrate.

2. The method according to claim 1, further comprising the step of determining the second printing element to be equal to the first printing element.

3. The method according to claim 1, further comprising the step of retrieving the tolerated deviation from a control unit of the inkjet printer.

4. The method according to claim 1, further comprising the step of retrieving the tolerated deviation from the print data.

5. The method according to claim 1, further comprising the steps of:

determining a range of possible distances between the first location and the second location; and determining the second printing element is further based on the determined range.

6. The method according to claim 5, further comprising the step of determining the second printing element such that the determined range is compatible with the tolerated deviation.

7. The method according to claim 6, wherein the step of determining the range comprises a step of estimating the second location by means of the deviation angle of the second printing element, the second intended position, a distance between the second printing element and the substrate, and a relative velocity of the print head with respect to the substrate.

8. The method according to claim 7, wherein the step of determining the range comprises a step of scanning the first location on the substrate with a scanner of the inkjet printer.

9. The method according to claim 7, wherein the step of determining the range comprises a step of estimating the first location by means of the deviation angle of the first printing element, the first intended position, the distance between the first printing element and the substrate and a relative velocity of the print head with respect to the substrate.

10. The method according to claim 1, wherein the method steps are repeated for a plurality of pairs of a first dot and a second dot.

11. The method according to claim 10, wherein, for each of the plurality of pairs of dots, a first dot of the pair is part of an edge of a first image element of the image and a second dot of the pair is part of an edge of a second image element of the image.

12. The method according to claim 11, wherein the edge of the first image element is opposite and parallel to the edge of the second image element.

13. The method according to claim 12, wherein the first image element and the second image element are part of a mask for producing a solar cell.

14. An inkjet printer comprising a control unit configured to execute the method according to claim 1.

15. A non-transitory recording medium comprising programs to execute the method of claim 1.

* * * * *